US010746414B2

(12) United States Patent
Gowdagiri et al.

(10) Patent No.: US 10,746,414 B2
(45) Date of Patent: Aug. 18, 2020

(54) FLUE VENT ADAPTER FOR MULTI-POISE FURNACE

(71) Applicant: Trane International Inc., Davidson, NC (US)

(72) Inventors: Sandeep Gowdagiri, Tyler, TX (US); Joshua Brian Coley, Tyler, TX (US); Andrew Hamilton Hanks, Tyler, TX (US); Kevin Joseph Ligi, Tyler, TX (US); John Bailey, Tyler, TX (US)

(73) Assignee: Trane International Inc., Davidson, NC (US)

( * ) Notice: Subject to any disclaimer, the term of this patent is extended or adjusted under 35 U.S.C. 154(b) by 305 days.

(21) Appl. No.: 15/582,299

(22) Filed: Apr. 28, 2017

(65) Prior Publication Data

US 2018/0313548 A1 Nov. 1, 2018

(51) Int. Cl.
*F24D 5/00* (2006.01)
*F24D 5/02* (2006.01)
(Continued)

(52) U.S. Cl.
CPC ..... *F24D 5/00* (2013.01); *F23J 11/00* (2013.01); *F23J 13/04* (2013.01); *F24D 5/02* (2013.01);
(Continued)

(58) Field of Classification Search
CPC ..... F24D 5/00; F24D 5/04; F24D 5/02; F24F 2007/003
(Continued)

(56) References Cited

U.S. PATENT DOCUMENTS 339,966 A * 4/1886 Brinkerhoff ..... F23L 17/005 126/80
354,766 A * 12/1886 Brinkerhoff ..... F23L 17/005 126/80
(Continued)

FOREIGN PATENT DOCUMENTS

JP 63210549 A * 9/1988
WO WO-2004076954 A1 * 9/2004 ..... F28F 1/006

OTHER PUBLICATIONS

"Definition—Substantially—Dictionary.com.pdf", definition, https://www.dictionary.com, Oct. 24, 2019.*
(Continued)

*Primary Examiner* — Steven B McAllister
*Assistant Examiner* — Daniel E. Namay
(74) *Attorney, Agent, or Firm* — Conley Rose, P.C.; J. Robert Brown, Jr.; Kristian R. Sullivan

(57) ABSTRACT

A furnace may include a furnace cabinet, an inducer blower, and a flue vent adapter. The furnace is configured as a multi-poise furnace and configured to be installed and operated in each of the horizontal left flow orientation, the horizontal right flow orientation, the upflow orientation, and the downflow orientation. The flue vent adapter is used when the furnace is installed and operated in the downflow orientation. Alternatively, the flue vent adapter is used when the furnace is installed and operated in each of the horizontal left flow orientation and the horizontal right flow orientation. The flue vent adapter has a unitary construction to reduce manufacturing costs, reduce a pressure drop through the flue vent adapter, and reduce leakage.

22 Claims, 9 Drawing Sheets

(51) Int. Cl.

| | |
|---|---|
| ***F24D 5/04*** | (2006.01) |
| ***F23J 13/04*** | (2006.01) |
| ***F23J 11/00*** | (2006.01) |
| ***F24H 9/00*** | (2006.01) |
| ***F24H 3/06*** | (2006.01) |
| *F24F 7/007* | (2006.01) |
| *F24F 13/26* | (2006.01) |
| *F24F 13/32* | (2006.01) |

(52) U.S. Cl.
CPC ..... *F24D 5/04* (2013.01); *F24H 3/065* (2013.01); *F24H 9/0068* (2013.01); *F23J 2900/13022* (2013.01)

(58) Field of Classification Search
USPC ..... 126/104 A, 110 AA, 116 R, 114, 312; 454/339, 340
See application file for complete search history.

(56) References Cited

U.S. PATENT DOCUMENTS 1,473,676 A * 11/1923 Hendrix ..... F24D 5/00 126/113
3,920,271 A * 11/1975 Bluestone ..... F16L 43/001 285/148.22
4,580,324 A * 4/1986 Laska ..... B21D 41/02 29/890.049
4,848,314 A * 7/1989 Bentley ..... F28F 19/04 126/116 R
4,899,726 A 2/1990 Waterman
5,317,992 A * 6/1994 Joyce ..... F23C 5/00 122/18.31
5,337,952 A * 8/1994 Thompson ..... F23N 1/002 236/10
5,340,028 A * 8/1994 Thompson ..... F23N 1/002 236/10
5,347,980 A 9/1994 Shellenberger
5,368,010 A 11/1994 Weber, III et al.
5,375,586 A * 12/1994 Schumacher ..... F24H 8/006 126/110 R
5,439,050 A 8/1995 Waterman et al.
5,582,159 A 12/1996 Harvey et al.
5,749,355 A 5/1998 Roan et al.
6,494,199 B1 12/2002 Zia et al.
8,584,664 B2 * 11/2013 Sarimurat ..... F04D 29/281 126/110 A
2002/0048738 A1 * 4/2002 Garloch ..... F23L 17/005 431/75
2004/0180305 A1 * 9/2004 Dempsey ..... F23D 14/72 431/139
2008/0314375 A1 * 12/2008 Khan ..... F24H 3/087 126/116 R
2011/0154812 A1 * 6/2011 Butler ..... F01N 13/08 60/324
2012/0085334 A1 * 4/2012 Beck ..... F24H 3/087 126/114
2012/0090590 A1 * 4/2012 Rieke ..... F24H 3/087 126/110 R
2012/0178031 A1 * 7/2012 Roy ..... F23D 14/62 431/12
2014/0165990 A1 * 6/2014 Noman ..... F24D 5/00 126/110 R
2015/0338088 A1 * 11/2015 Chase ..... F24H 3/08 126/116 R
2015/0369495 A1 * 12/2015 Maricic ..... F24H 8/00 126/116 A
2016/0186990 A1 * 6/2016 Gedcke ..... F23C 7/008 126/116 B
2016/0363346 A1 * 12/2016 Vargo ..... F24H 8/006
2017/0038081 A1 * 2/2017 Lai ..... F24D 5/00
2018/0058724 A1 * 3/2018 Haynes ..... F23L 9/02
2018/0080659 A1 * 3/2018 Brake ..... F24D 5/02

OTHER PUBLICATIONS

Lennox Industries Inc.; "Unit Information—ML180DF(X)"; Lennox Service Literature; Feb. 2013; 27 pages.

* cited by examiner

FLUE VENT ADAPTER FOR MULTI-POISE FURNACE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems often include a furnace in many commercial and residential applications for heating and otherwise conditioning interior spaces. Installation of a furnace requires connecting an inducer blower of the furnace to a flue vent to carry and/or vent combusted flue gases from the structure in which the furnace is installed.

SUMMARY

In some embodiments of the disclosure, a flue vent adapter for a furnace is disclosed as comprising: a furnace cabinet; an inducer blower; flue vent transition; and a flue vent adapter comprising: an inlet; an outlet; and a substantially 90 degree bend disposed between the inlet and the outlet; wherein the flue vent adapter is connected between the inducer blower and the flue vent transition that is connected to a flue vent when the furnace is configured in a downflow orientation.

In other embodiments of the disclosure, a furnace is disclosed as comprising: an inlet; an outlet; and a substantially 90 degree bend disposed between the inlet and the outlet; wherein the flue vent adapter is connected between the inducer blower and the flue vent transition that is connected to a flue vent when the furnace is configured in a downflow orientation.

In yet other embodiments of the disclosure, a method of manufacturing a flue vent adapter for a furnace is disclosed as comprising: providing a substantially round tube; forming a bend in the substantially round tube; compressing a front side and a back side of a first end of the tube and compressing a left side and a right side of a second end of the tube; forming an elliptical portion near the second end of the tube; and forming a rectangular-shaped inlet at the first end of the tube and forming an outlet at the second end of the tube.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
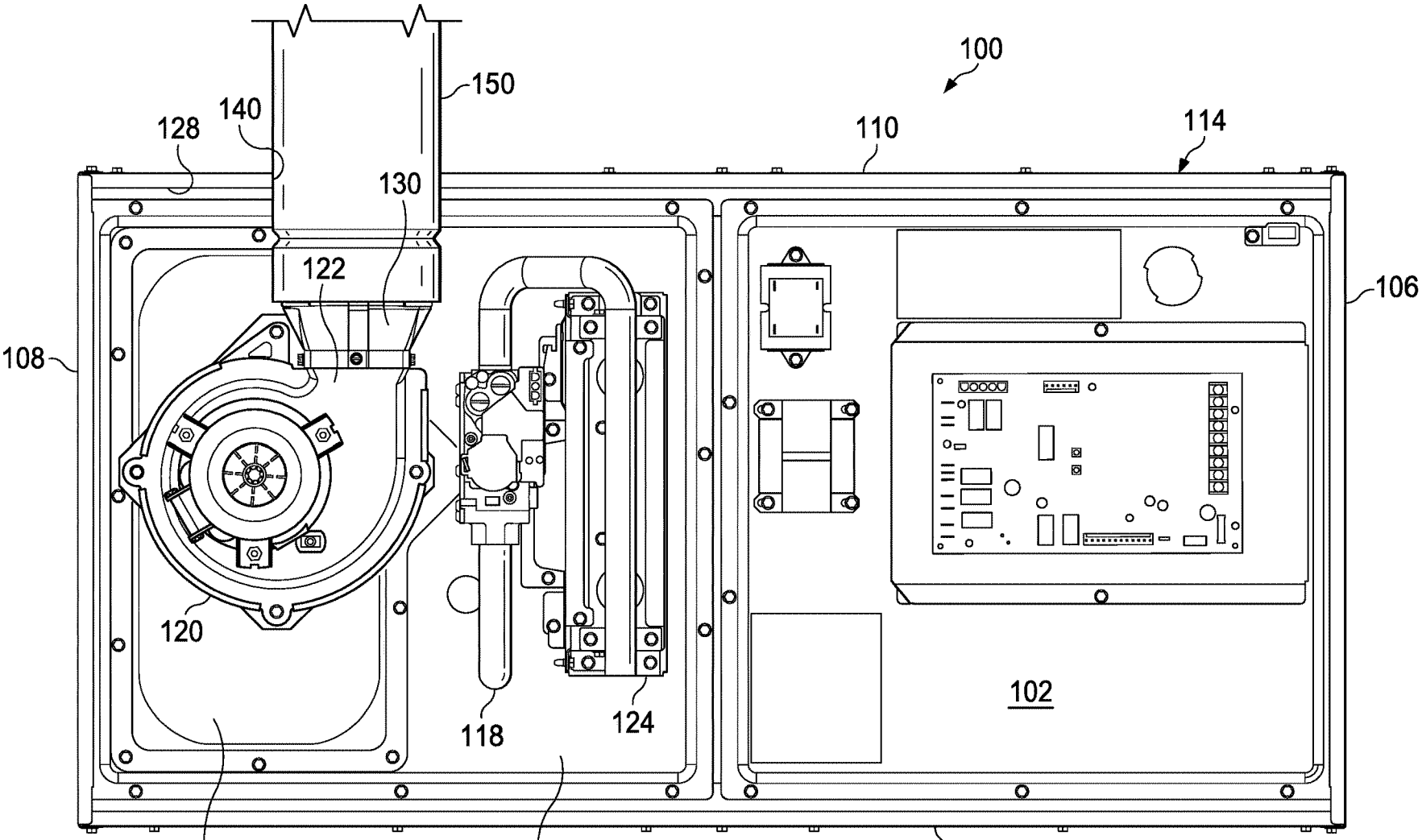
FIG. 1 is a front view of a furnace configured in a horizontal left flow orientation according to an embodiment of the disclosure.

Referring now to FIGS. 1-5, a front view of a furnace 100 configured in a horizontal left flow orientation, a front view of the furnace 100 configured in a horizontal right flow orientation, a front view of the furnace 100 configured in an upflow orientation, a front view of the furnace 100 configured in a downflow orientation, and a partial oblique view of the furnace 100 configured in the downflow orientation, are shown, respectively, according to an embodiment of the disclosure. Furnace 100 generally comprises a front side 102, a back side 104, a top side 106, a bottom side 108, a left side 110, and a right side 112. Such directional descriptions are meant to assist the reader in understanding the physical orientation of the various components of the furnace 100. However, such directional descriptions shall not be interpreted as limitations to the possible installation orientations of furnace 100. Attachment of directional descriptions at different locations or two different components of furnace 100 shall not be interpreted as indicating absolute locations of directional limits of the furnace 100. Instead, a plurality of shown and/or labeled directional descriptions in a single figure shall provide general directional orientation to the reader so that directionality may be easily followed amongst the various figures. Still further, the component parts and/or assemblies of the furnace 100 may be described below as generally having front, back, top, bottom, left, and right sides which should be understood as being consistent in orientation with the front side 102, back side 104, top side 106, bottom side 108, left side 110, and right side 112 of the furnace 100.

Furnace 100 comprises a furnace cabinet 114, a partition panel 116, a gas inlet 118, an inducer blower 120 having an exhaust outlet 122, a burner 124 configured to receive a flow of fuel through the gas inlet 118, and a cold header 126 configured to mount the inducer blower 120 to the partition panel 116 and/or the furnace 100. In this embodiment, the furnace 100 comprises a non-condensing gas furnace and comprises at least one primary heat exchanger (not shown, view obstructed by partition panel 116) connected in fluid communication between the inducer blower 120 and the burner 124. In other embodiments, however, the furnace 100 may comprise a condensing gas furnace and comprise a secondary heat exchanger connected in fluid communication to the at least one primary heat exchanger via a hot header. Furnace 100 also comprises an interior space 128 accessible by opening a door and/or removing an outer panel of the furnace 100, a flue vent transition 130 configured to connect the exhaust outlet 122 of the inducer blower 120 to at least one of a flue vent adapter 200 and a flue vent 150, and at least one flue vent opening 140 to allow ingress and/or egress of the flue vent 150 through at least one side 102, 104, 106, 108, 110, 112 of the furnace cabinet 114 of furnace 100 and into the interior space 128 of the furnace cabinet 114 of the furnace 100. Furthermore, furnace 100 may also comprise a plurality of other components (e.g. gas inlet 118 regulator, inducer blower 120 controller, burner 124 controller, temperature sensors, pressure sensors, and or other control system hardware).

The furnace 100 may generally comprise a four-walled fluid duct configured to receive an airflow therethrough. The partition panel 116 may generally provide a barrier between the four-walled fluid duct and the interior space 128 of the furnace 100 and be configured to provide a mounting surface for the cold header 126 that carries the inducer blower 120. The burner 124 may be configured to receive a flow of fuel through the gas inlet 118 and combust an air/fuel mixture, while the inducer blower 120 draws the combusted and heated air/fuel mixture from the burner 124 through the heat exchanger to exchange heat with an airflow passing through the four-walled fluid duct portion of the furnace 100. The heated airflow through the four-walled fluid duct portion of the furnace 100 may then be passed into an interior space of a structure in which the furnace 100 is installed to provide a temperature conditioned airflow into the interior space of the structure. After passing through the heat exchanger and exchanging heat with the airflow through the four-walled duct of the furnace 100, the combusted air/fuel mixture may be drawn through the inducer blower 120, where the combusted air/fuel mixture may exit the inducer blower 120 through the exhaust outlet 122 and out of the furnace cabinet 114 through the flue vent 150.

In some embodiments, the inducer blower 120 may comprise a substantially rectangular-shaped exhaust outlet 122. As such, the flue vent transition 130 may generally comprise a substantially rectangular-shaped inlet of the flue vent transition 130 that attaches to the exhaust outlet 122 of the inducer blower 120. Additionally, the flue vent transition 130 may transition from the substantially rectangular-shaped inlet to a substantially round-shaped outlet of the flue vent transition 130 that attaches to the flue vent 150. As such, the substantially rectangular-shaped exhaust outlet 122 may be connected in fluid communication to the substantially round-shaped flue vent 150 via the flue vent transition 130. However, as will be discussed in further detail herein, when the furnace 100 is installed in the downflow orientation, at least in some embodiments, the flue vent transition 130 may be configured to connect a flue vent adapter 200 that is connected to the exhaust outlet 122 of the inducer blower 120 to the flue vent 150.

Furthermore, it will be appreciated that the furnace 100 may generally comprise a multi-poise furnace and be configured to be installed and operated in each of the horizontal left flow orientation, the horizontal right flow orientation, the upflow orientation, and the downflow orientation. As such, it will further be appreciated that the inducer blower 120 may be mounted to the cold header 126 in a plurality of positions. More specifically, the inducer blower 120 may be rotated (at least in 90 degree increments) and mounted to the cold header 126 in at least four different positions to allow installation and operation of the furnace 100 in each of the horizontal left flow orientation, the horizontal right flow orientation, the upflow orientation, and the downflow orientation. To accommodate the different orientations of the furnace 100, the furnace 100 may comprise multiple flue vent openings 140. As such, the furnace cabinet 114 may comprise multiple flue vent opening 140 cutouts (shown specifically in FIG. 5). The cutouts for the multiple positions of the flue vent opening 140 may comprise scored areas, partially-milled outlines, at least partially punched and/or removed areas, and/or other features to allow easy removal of at least a portion of material of the furnace cabinet 114 to provide and/or form the flue vent opening 140. Further, the furnace cabinet 114 may comprise these features in each of the predetermined locations for the flue vent opening 140 for each of the furnace 100 orientations.

Referring specifically now to FIG. 1, the furnace 100 may generally be configured to be installed and operated in the horizontal left flow orientation. In the horizontal left flow orientation, the furnace cabinet 114 may be oriented with the left side 110 of the furnace 100 facing in an upwards direction. Additionally, the inducer blower 120 may be oriented with the exhaust outlet 122 of the inducer blower 120 facing the left side 110 of the furnace 100. Accordingly, the flue vent opening 140 may be disposed in the left side 110 of the furnace cabinet 114, and the flue vent 150 may enter the interior space 128 of the furnace cabinet 114 through the flue vent opening 140.

Figure 2:
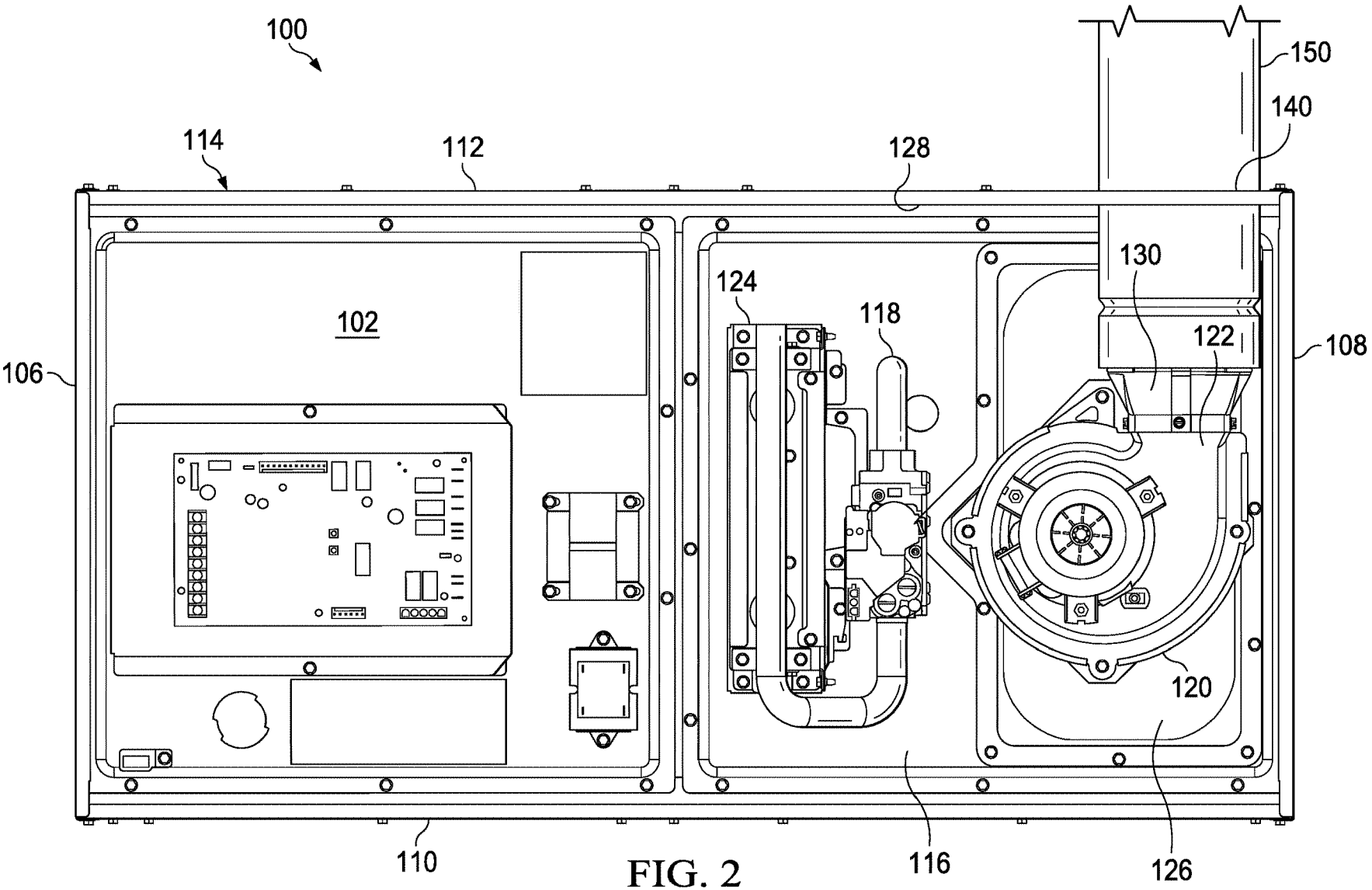
FIG. 2 is a front view of the furnace of FIG. 1 configured in a horizontal right flow orientation according to an embodiment of the disclosure.

Referring specifically now to FIG. 2, the furnace 100 may generally be configured to be installed and operated in the horizontal right flow orientation. In the horizontal right flow orientation, the furnace cabinet 114 may be oriented with the right side 112 of the furnace 100 facing in an upwards direction. Additionally, the inducer blower 120 may be oriented with the exhaust outlet 122 of the inducer blower 120 facing the right side 112 of the furnace 100. Accordingly, the flue vent opening 140 may be disposed in the right side 112 of the furnace cabinet 114, and the flue vent 150 may enter the interior space 128 of the furnace cabinet 114 through the flue vent opening 140.

Figure 3:
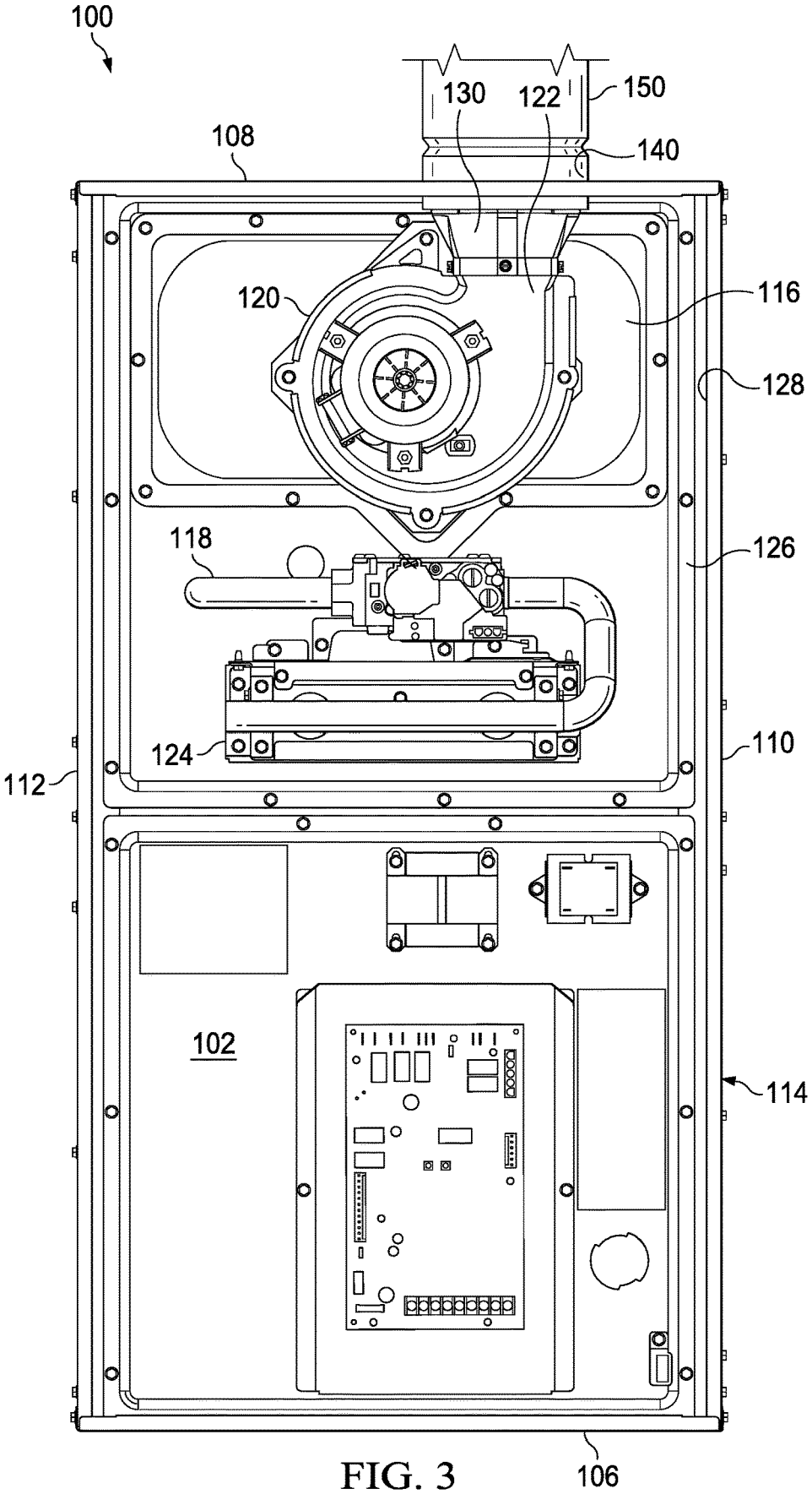
FIG. 3 is a front view of the furnace of FIGS. 1 and 2 configured in an upflow orientation according to an embodiment of the disclosure.

Referring specifically now to FIG. 3, the furnace 100 may generally be configured to be installed and operated in the upflow orientation. In the upflow orientation, the furnace cabinet 114 may be oriented with the bottom side 108 of the furnace 100 facing in an upwards direction. Additionally, the inducer blower 120 may be oriented with the exhaust outlet 122 of the inducer blower 120 facing the bottom side 108 of the furnace 100. Accordingly, the flue vent opening 140 may be disposed in the bottom side 108 of the furnace cabinet 114, and the flue vent 150 may enter the interior space 128 of the furnace cabinet 114 through the flue vent opening 140.

Figure 4:
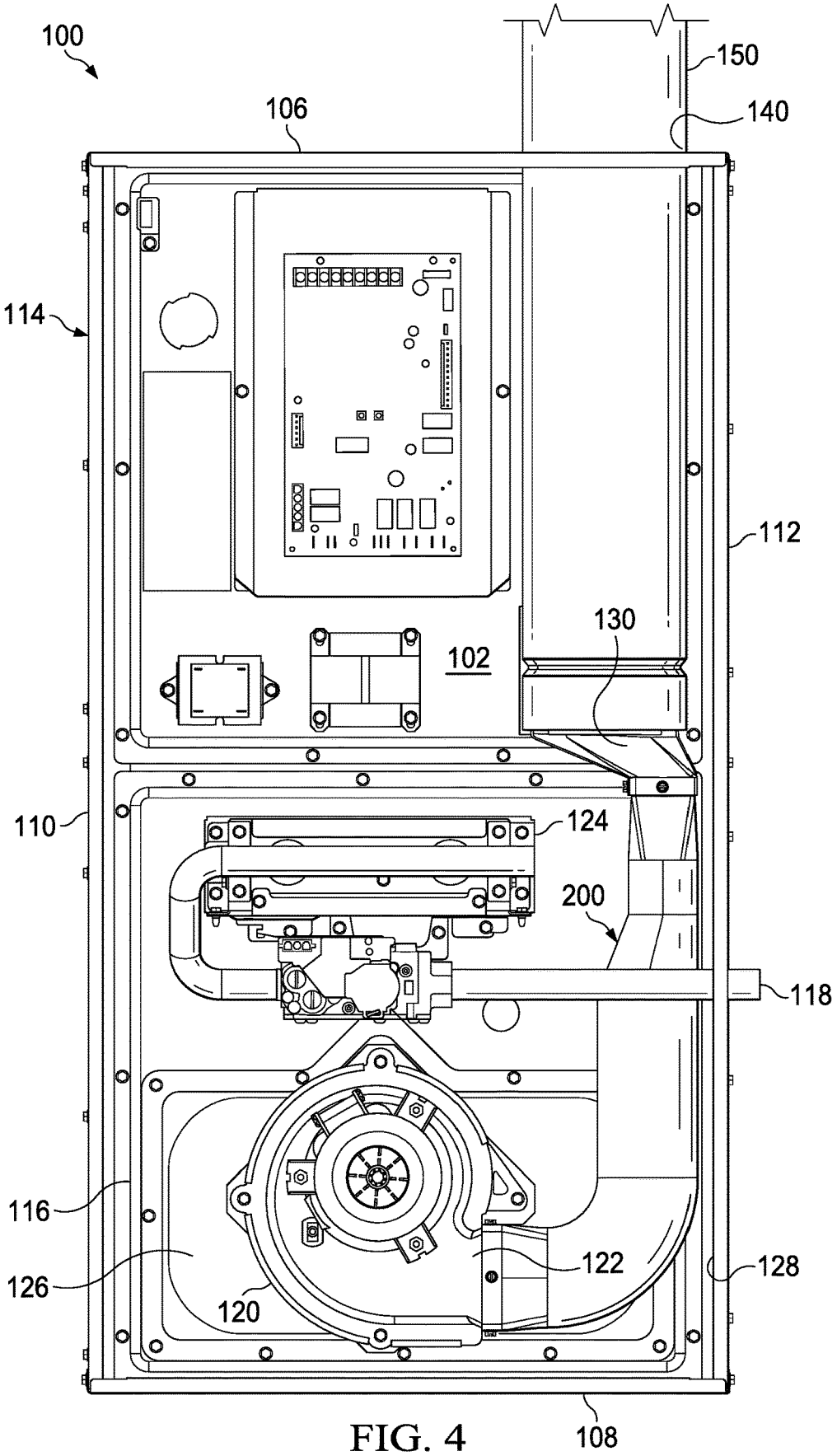
FIG. 4 is a front view of the furnace of FIGS. 1-3 configured in a downflow orientation according to an embodiment of the disclosure.
Figure 5:
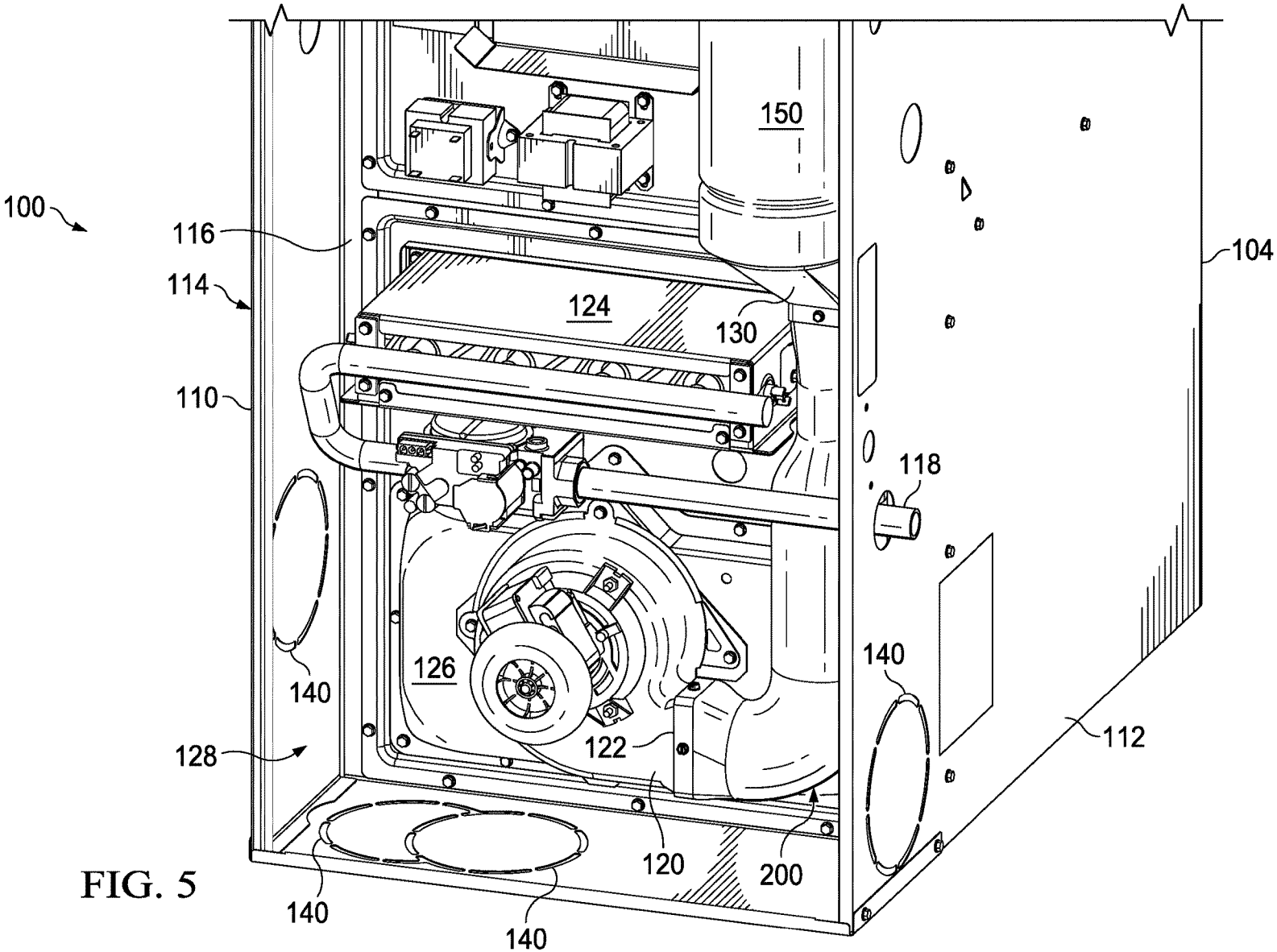
FIG. 5 is a partial oblique view of the furnace of FIGS. 1-4 configured in the downflow orientation according to an embodiment of the disclosure.

Referring specifically now to FIGS. 4 and 5, the furnace 100 may generally be configured to be installed and operated in the downflow orientation. In the downflow orientation, the furnace cabinet 114 may be oriented with the top side 106 of the furnace 100 facing in an upwards direction. However, the inducer blower 120 may be oriented with the exhaust outlet 122 of the inducer blower 120 facing the right side 112 of the furnace 100. Furthermore, when the furnace 100 is installed in the downflow orientation, the flue vent transition 130 may be configured to connect a flue vent adapter 200 that is connected to the exhaust outlet 122 of the inducer blower 120 to the flue vent 150. The flue vent adapter 200 may comprise a fluid duct that forms a 90 degree turn to carry the combusted air/fuel mixture from the exhaust outlet 122 of the inducer blower 120 through the flue vent adapter 200 that makes a 90 degree turn towards the top side 106 of the furnace cabinet 114. Accordingly, the flue vent opening 140 may be disposed in the top side 106 of the furnace cabinet 114, and the flue vent 150 may enter the interior space 128 of the furnace cabinet 114 through the flue vent opening 140.

Figure 7:
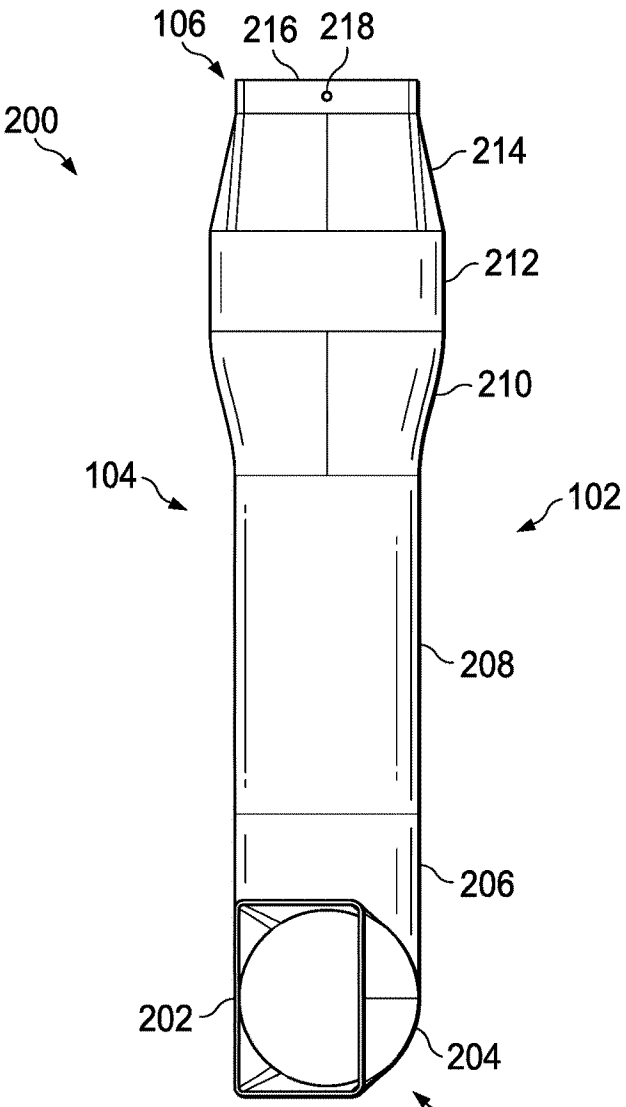
FIG. 7 is a left side view of the flue vent adapter of the furnace of FIGS. 1-5 according to an embodiment of the disclosure.
Figure 6:
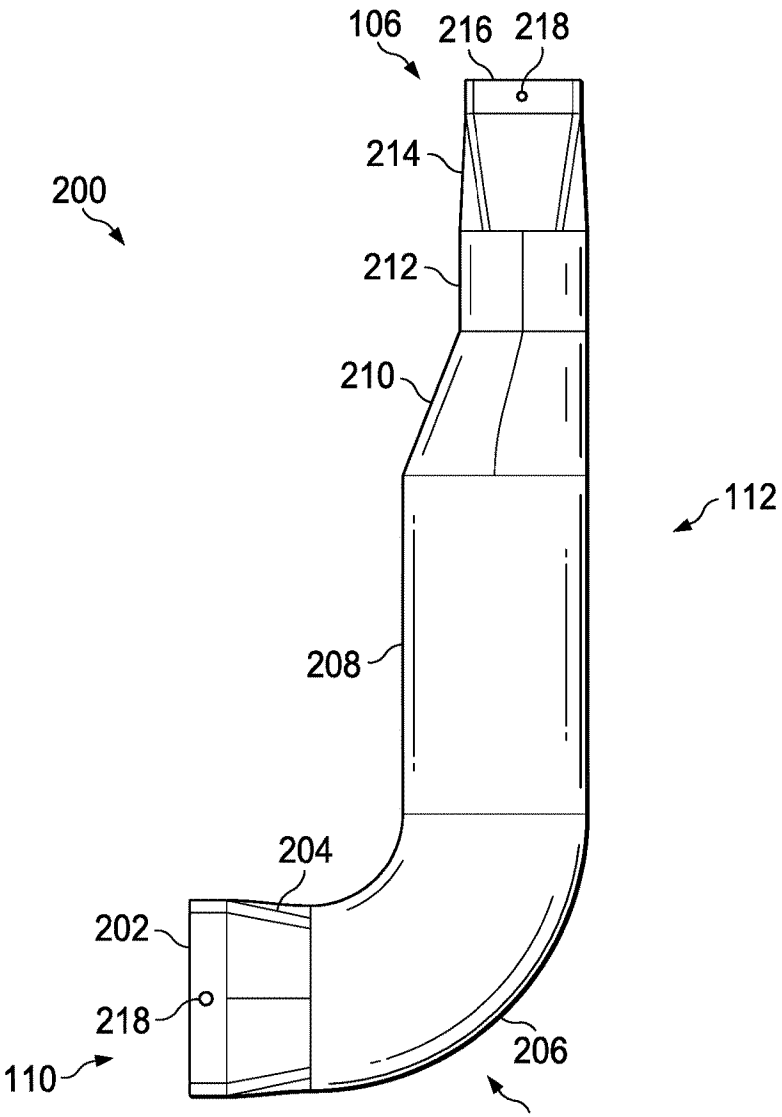
FIG. 6 is a front view of the flue vent adapter of the furnace of FIGS. 1-5 according to an embodiment of the disclosure.

Referring now to FIGS. 6 and 7, a front view and a left side view of the flue vent adapter 200 of the furnace 100 of FIGS. 1-5 are shown, respectively, according to an embodiment of the disclosure. As stated, the flue vent adapter 200 may comprise a compact design and be configured to be installed when the furnace 100 is oriented in the downflow orientation. The flue vent adapter 200 comprises an inlet 202, a first transition 204, a bend 206, a straight section 208, a second transition 210, an elliptical portion 212, a third transition 214, an outlet 216, and a plurality of mounting holes 218 in at least two sides of the inlet 202 and the outlet 216. The flue vent adapter 200 may generally be formed from substantially round, constant diameter tubing. However, the flue vent adapter 200 comprises features that deviate from the substantially round tubing shape.

More specifically, the flue vent adapter 200 may generally comprise a substantially rectangular-shaped inlet 202 directly connected to the substantially rectangular-shaped exhaust outlet 122 of the inducer blower 120 and secured thereto by fasteners disposed through the plurality of mounting holes 218 in the substantially rectangular-shaped inlet 202. The inlet 202 of the flue vent adapter 200 may generally be open to a left side 110 of the furnace cabinet 114 to receive the exhaust outlet 122 of the inducer blower 120. The back side 104 of the inlet 202 may also be substantially tangent with the back side 104 of the straight section 208. Accordingly, in some embodiments, this tangential relationship allows the flue vent adapter 200 to avoid contact and/or interference with the cold header 126. The first transition 204 extends from the substantially rectangular-shaped inlet 202 and transitions the shape of the flue vent adapter 200 from the substantially rectangular-shape of the inlet 202 to a substantially round shape of the bend 206. The bend 206 may generally comprise a substantially round, constant diameter that may be formed via mandrel bending. This results in the bend 206 being free of crimps, wrinkles, and/or other deformations. The bend 206 may also comprise a substantially 90 degree bend 206 (commonly referred to as a 90 degree elbow). From the bend 206, a substantially straight section 208 may extend toward a top side 106 of the furnace cabinet 114.

The straight section 208 may end at the second transition 210 that transitions the shape of the flue vent adapter 200 from the substantially round shape of the straight section 208 to an elliptical portion 212. It will be appreciated that the second transition 210 may be formed by reducing a left side 110 dimension of the flue vent adapter 200, such that a right side 112 of the flue vent adapter 200 remains substantially linear from the bend 206 to the top side 106 of the elliptical portion 212. Thus, the right side 112 of each of the straight section 208, the second transition 210, and the elliptical portion 212 may be substantially tangent to the bend 206 and/or be substantially parallel to a right side 112 of the furnace cabinet 114. In some embodiments, the elliptical portion 212 may comprise a plurality of diameters. However, in other embodiments, the elliptical portion 212 may comprise a substantially oval shape. From the elliptical portion 212, a third transition 214 may extend and transition the shape of the flue vent adapter 200 from the substantially elliptical-shaped elliptical portion 212 to the substantially rectangular-shaped outlet 216, which may be received by and directly connected to the substantially rectangular-shaped inlet 202 of the flue vent transition 130 and secured thereto by fasteners disposed through the plurality of mounting holes 218 in the substantially rectangular-shaped outlet 216. In some embodiments, the inlet 202 and the outlet 216 may comprise substantially similar dimensions.

The flue vent adapter 200 may generally comprise a substantially unitary construction, formed from a single piece of substantially round, constant diameter tubing. In some embodiments, the flue vent adapter 200 may be formed from at least 2.50 inch diameter tubing, at least 2.75 inch diameter tubing, and/or at least 3.00 inch diameter tubing. By forming the flue vent adapter 200 from a single piece of substantially round, constant diameter tubing, the flue vent adapter 200 may reduce manufacturing costs as compared to a flue vent adapter formed via multiple components and requiring additional joining processes, reduce a pressure drop through the flue vent adapter 200 as compared to a flue vent adapter having other profiles, and/or reduce leakage from the flue vent adapter 200 as compared to a flue vent adapter that has welds, fasteners, or other multiple parts joined together by eliminating seams, interfaces, and/or other joints where fluids may escape from a flue vent adapter.

Referring back to FIGS. 4 and 5 in conjunction with FIGS. 6 and 7, the flue vent adapter 200 may generally comprise a compact design and be formed to fit in the limited interior space 128 of the furnace cabinet 114 of the furnace 100. More specifically, by orienting the inducer blower 120 with the exhaust outlet 122 facing the right side 112 of the furnace cabinet 114, the flue vent adapter 200 may extend towards the right side 112 of the furnace cabinet 114, where the bend 206 of the flue vent adapter 200 reorients the flue vent adapter 200 towards the top side 106 of the furnace cabinet 114. Thus, the flue vent adapter 200 may pass behind and avoid interference with the gas inlet 118. Additionally, by providing the second transition 210 and/or the elliptical portion 212, the flue vent adapter 200 maximizes the area to clear and/or avoid contact and/or interference with the burner 124. Still further, by orienting a back side 104 of the inlet 202 substantially tangent to the back side 104 of the straight section 208, the flue vent adapter 200 is also configured to avoid contact and/or interference with the cold header 126.

It will be appreciated that while the flue vent adapter 200 may be installed when the furnace 100 is configured in the downflow orientation of FIGS. 4 and 5, the flue vent adapter 200 may also be employed when the furnace 100 is configured in each of the horizontal left flow orientation of FIG. 1 and the horizontal right flow orientation of FIG. 2. To use the flue vent adapter 200 in either of the horizontal left flow orientation or the horizontal right flow orientation, the inducer blower 120 may be oriented with the exhaust outlet 122 of the inducer blower 120 facing the right side 112 of the furnace 100, similar to the downflow orientation of FIG. 5. The flue vent adapter 200 may be connected to the exhaust outlet 122 of the inducer blower 120 and the flue vent transition 130 in a manner substantially similar to that of the downflow orientation of FIG. 5. Accordingly, the flue vent opening 140 may be disposed in the top side 106 of the furnace cabinet 114, and the flue vent 150 may enter the interior space 128 of the furnace cabinet 114 through the flue vent opening 140 in the top side 106. However, in each of the horizontal left flow orientation and the horizontal right flow orientation with the flue vent adapter 200, the flue vent 150 will comprise a 90 degree flue vent bend 206 to orient the portion of the flue vent 150 extending from the furnace cabinet 114 in an upwards direction. However, in other embodiments, the flue vent 150 may extend horizontally from the furnace cabinet 114 and not comprise a 90 degree flue vent bend 206. Accordingly, it will be appreciated that the flue vent adapter 200 may be used in each of the horizontal left orientation, the horizontal right orientation, and the downflow orientation.

Figure 8:
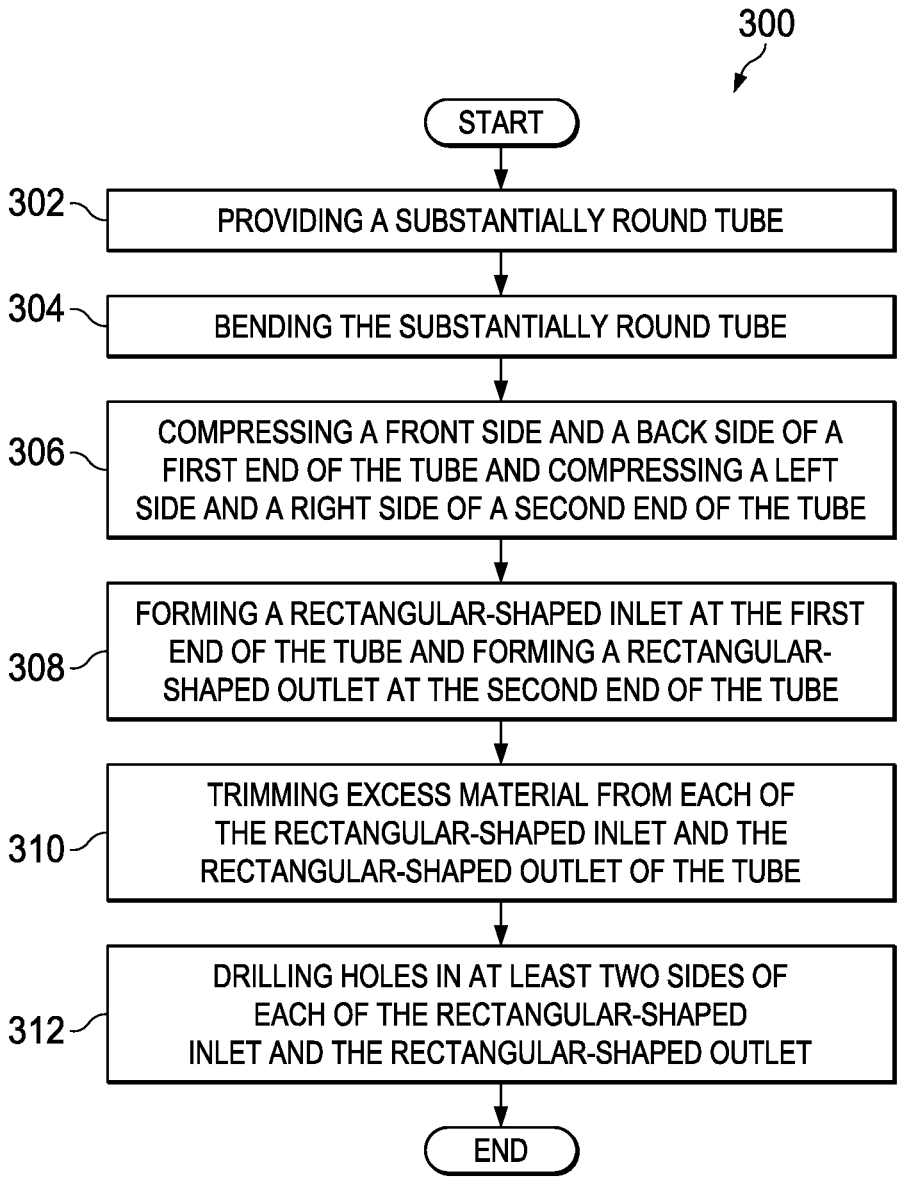
FIG. 8 is a flowchart of a method of manufacturing a flue vent adapter for a furnace according to an embodiment of the disclosure.

Referring now to FIG. 8, a flowchart of a method 300 of manufacturing a flue vent adapter 200 for a furnace 100 is shown according to an embodiment of the disclosure. The method 300 may begin at block 302 by providing a substantially round tube. The method 300 may continue at block 304 by bending the substantially round tube. In some embodiments, this may be accomplished by bending the tube using a mandrel. The method 300 may continue at block 306 by compressing a front side and a back side of a first end of the tube and compressing a left side and a right side of a second end of the tube. In some embodiments, the method 300 may also comprise forming an elliptical portion near the second end of the tube. The method 300 may continue at block 308 by forming a rectangular-shaped inlet at the first end of the tube and forming a rectangular-shaped outlet at the second end of the tube. The method 300 may continue at block 310 by trimming excess material from each of the rectangular-shaped inlet and the rectangular-shaped outlet of the tube. The method may conclude at block 312 by drilling holes in at least two sides of each of the rectangular-shaped inlet and the rectangular-shaped outlet.

Figure 9:
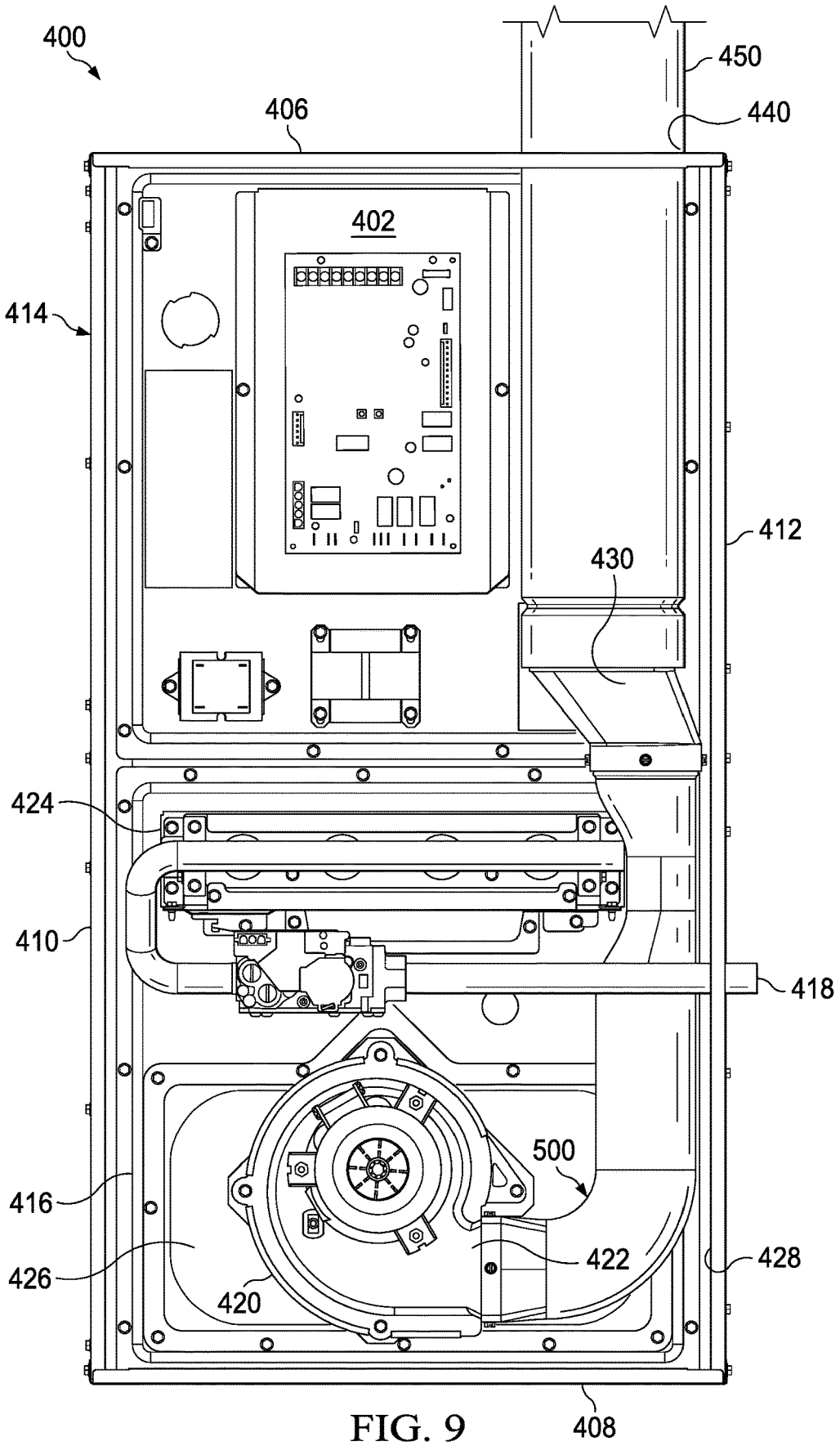
FIG. 9 is a front view of a furnace configured in the downflow orientation according to an alternative embodiment of the disclosure.

Referring now to FIG. 9, a front view of a furnace 400 configured in the downflow orientation is shown according to an embodiment of the disclosure. Furnace 400 may be substantially similar to furnace 100 of FIGS. 1-5 and comprise a front side 402, a back side 404, a top side 406, a bottom side 408, a left side 410, and a right side 412, a furnace cabinet 414, a partition panel 416, a gas inlet 418, an inducer blower 420 having an exhaust outlet 422, a burner 424 configured to receive a flow of fuel through the gas inlet 418, and a cold header 426 configured to mount the inducer blower 420 to the partition panel 416 and/or the furnace 400. Furnace 400 also comprises an interior space 428 accessible by opening a door and/or removing an outer panel of the furnace 400, a flue vent transition 430 configured to connect a flue vent adapter 500 to a flue vent 450, and at least one flue vent opening 440 to allow ingress and/or egress of the flue vent 450 through at least one side 402, 404, 406, 408, 410, 412 of the furnace cabinet 414 of furnace 400 and into the interior space 428 of the furnace cabinet 414 of the furnace 400. Furthermore, furnace 400 may also comprise a plurality of other components (e.g. gas inlet 418 regulator, inducer blower 420 controller, burner 424 controller, temperature sensors, pressure sensors, and/or other control system hardware). Additionally, it will be appreciated that while furnace 400 is shown configured in the downflow orientation, furnace 400 may also be installed in the upflow orientation, the horizontal left flow orientation, and the horizontal right flow orientation and be configured to be operate in a substantially similar manner to the furnace 100 of FIGS. 1-5.

Figure 11:
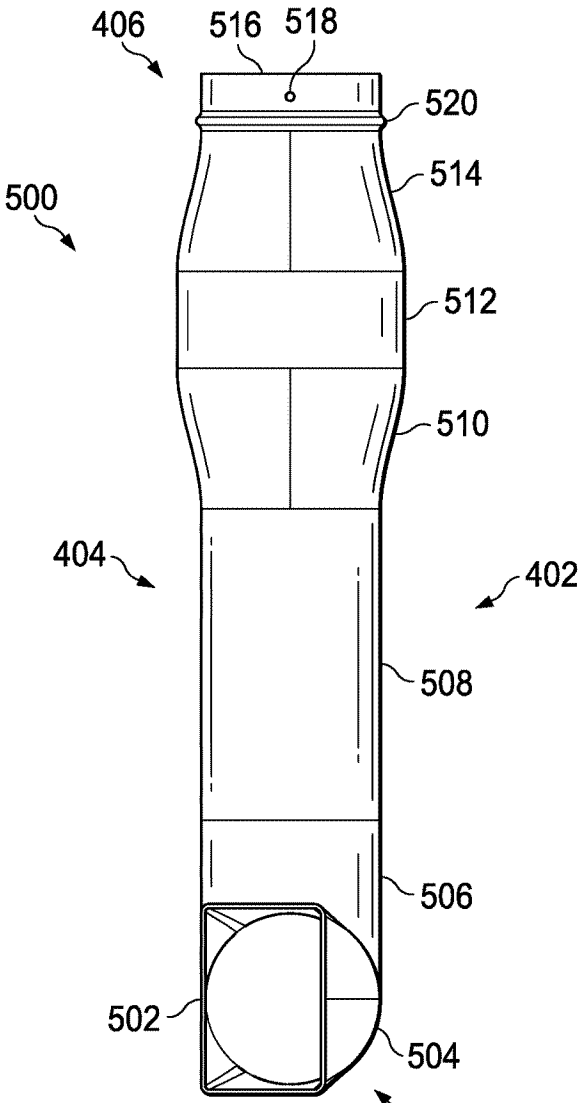
FIG. 11 is a left side view of a flue vent adapter according to an alternative embodiment of the disclosure.
Figure 10:
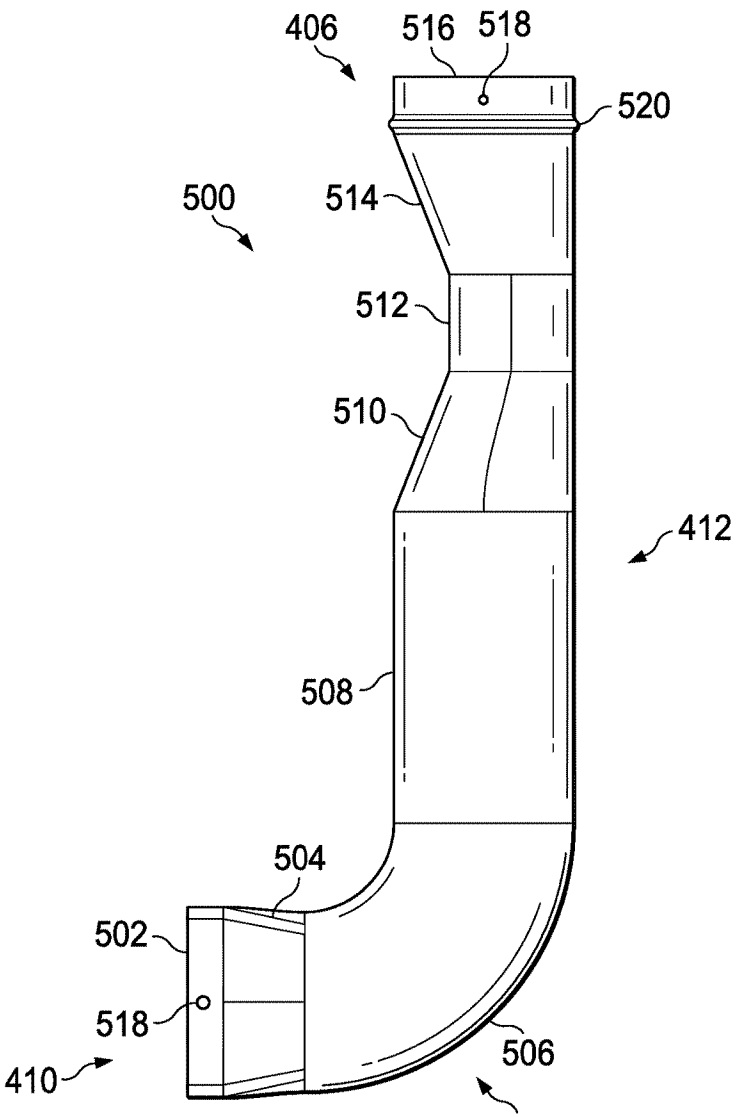
FIG. 10 is a front view of the flue vent adapter of the furnace of FIG. 9 according to an alternative embodiment of the disclosure.

Referring to FIGS. 10 and 11, a front view and a left side view of the flue vent adapter 500 of the furnace 400 of FIG. 9 are shown, respectively, according to an alternative embodiment of the disclosure. Flue vent adapter 500 may generally be substantially similar to flue vent adapter 200 of FIGS. 1-7 and comprise an inlet 502, a first transition 504, a bend 506, a straight section 508, a second transition 510, an elliptical portion 512, a third transition 514, an outlet 516, and a plurality of mounting holes 518 in at least two sides of the inlet 502 and the outlet 516. However, while flue vent adapter 500 may be substantially similar to flue vent adapter 200, flue vent adapter 500 comprises a third transition 514 that extends and transitions from the substantially elliptical-shaped elliptical portion 512 to the substantially round-shaped outlet 516. In some embodiments, the outlet 516 may comprise a substantially similar dimension as the straight section 508. Thus, in some embodiments, the straight section 508 and the outlet 516 may comprise a diameter of at least about 2.75 inches. Additionally, flue vent adapter 500 may also comprise a rolled bead 520 disposed between the third transition 514 and the outlet 516 that extends around the flue vent adapter 500.

It will be appreciated that the substantially round-shaped outlet 516 of the flue vent adapter 500 may be connected to an inlet of the flue vent transition 430. As such, the inlet of the flue vent transition 430 may receive the substantially round-shaped outlet 516 of the flue vent adapter 500 when the furnace 400 is configured in the downflow orientation. Further, the rolled bead 520 of the flue vent adapter 500 may act as a stop for the flue vent transition 430 by interfacing with the flue vent transition 430 to prevent the flue vent transition 430 from sliding too far onto the flue vent adapter 500. To prevent the flue vent transition 430 from sliding too far onto the flue vent adapter 500, the rolled bead 520 may comprise a larger outer diameter than the inner diameter of the inlet of the flue vent transition 430. The flue vent transition 430 may also transition to a larger round-shaped outlet that is connected to the flue vent 450. Thus, while furnace 400 may be substantially similar to furnace 100 of FIGS. 1-5, the flue vent adapter 500 comprises a substantially-round outlet 516 as compared to the substantially rectangular shaped outlet 216 of flue vent adapter 200 of FIGS. 1-7.

Accordingly, the flue vent transition 430 comprises a round-shaped inlet that is complementary and configured to receive at least a portion of the flue vent adapter 500 outlet 516. Additionally, it will be appreciated that the method of claim 8 may also be employed to manufacture the flue vent adapter 500 of FIGS. 9-11. However, the method 300 may, at block 308, comprise forming only a rectangular-shaped inlet at the first end of the tube and comprise no further processes at the outlet at the second end of the tube, which may already comprise a rounded outlet, such as outlet 516. In some embodiments, the method 300 may comprise forming the rolled bead 520 between the third transition 514 and the outlet 516. Additionally, in some embodiments, the rolled bead 520 may substantially retain and/or maintain the integrity of the round shape of the tube and/or the outlet 516 of the flue vent adapter 500 when the elliptical portion 512 is formed at block 306 of the method 300.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent.

Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A furnace, comprising:

a furnace cabinet comprising:

a top side;

a bottom side opposite the top side; and a cabinet outlet extending through the top side that is configured to receive a flue vent therethrough;

a burner within the furnace cabinet;

an inducer blower within the furnace cabinet configured to flow exhaust from the burner, wherein the furnace cabinet is in a downflow orientation such that the burner is between the inducer blower and the cabinet outlet and the furnace cabinet is configured to receive an airflow from the top side, past the burner and the inducer blower, and out through the bottom side;

a flue vent adapter comprising:

an inlet coupled to the inducer blower;

an outlet coupled to the flue vent transition;

a substantially 90 degree bend disposed between the inlet and the outlet; and a plurality of transitions to provide clearance for the burner when the flue vent adapter is disposed within the furnace cabinet, wherein the plurality of transitions comprises:

a first transition disposed between the bend and the outlet; and a second transition disposed between the first transition and the outlet;

wherein, when moving from the bend toward the outlet, the first transition includes a round shape that transitions into an elliptical shape and the second transition includes an elliptical shape that transitions to a shape of the outlet, and a flue vent transition is coupled between the outlet of the flue vent adapter and the flue vent, wherein the flue vent transition transitions from the shape of the outlet to a shape of the flue vent.

2. The furnace of claim 1, wherein the inlet comprises a substantially rectangular shape, and wherein the shape of the outlet comprises at least one of a substantially rectangular shape and a substantially round shape.

3. The furnace of claim 2, wherein the flue vent adapter is carried within the furnace cabinet; wherein the inlet and the outlet comprise mounting holes.

4. The furnace of claim 2, wherein the flue vent adapter comprises a third transition between the inlet and the bend, wherein the third transition comprises a round shape that transitions into a round shape.

5. The furnace of claim 1, wherein the flue vent extends into the furnace cabinet to engage with the flue vent transition; and wherein the shape of the outlet comprises a round shape.

6. The furnace of claim 1, wherein the flue vent adapter comprises an elliptical portion thatis between the first and second transitions.

7. The furnace of claim 1, wherein the flue vent adapter comprises a round portion that is between the bend and the first transition.

8. A flue vent adapter system for a furnace, comprising:

a flue vent adapter, comprising:

an inlet;

an outlet;

a substantially 90 degree bend disposed between the inlet and the outlet; and a plurality of transitions to provide clearance for a burner when the flue vent adapter is disposed within a furnace cabinet, wherein the plurality of transitions comprises:

a first transition disposed between the bend and the outlet; and a second transition disposed between the first transition and the outlet, wherein, moving from the bend toward the outlet, the first transition includes a round shape that transitions into an elliptical shape, and the second transition includes an elliptical shape that transitions to a shape of the outlet; and a flue vent transition configured to be coupled between the flue vent adapter and a flue vent, wherein the flue vent transition transitions from the shape of the outlet to a shape of the flue vent;

wherein the flue vent adapter is configured to be connected between an inducer blower and the flue vent transition.

9. The flue vent adapter system of claim 8, wherein the shape of the outlet comprises a round shape.

10. The flue vent adapter system of claim 8, wherein the shape of the outlet comprises a rectangular shape.

11. The flue vent adapter system of claim 8, wherein the flue vent adapter further comprises a straight section adjacent to the bend and the first transition.

12. The flue vent adapter system of claim 8, wherein the flue vent adapter further comprises an elliptical portion that is between the first and second transitions.

13. The flue vent adapter system of claim 12, further comprising:

a rolled bead disposed adjacent the outlet, wherein the rolled bead is configured to provide a stop for the second transition.

14. The flue vent adapter system of claim 8, wherein the flue vent adapter and the flue vent transition are configured to be carried entirely within the furnace.

15. The flue vent adapter system of claim 8, wherein the inlet comprises a rectangular shape.

16. The flue vent adapter system of claim 15, comprising a third transition between the inlet and the bend, wherein the third transition includes a rectangular shape that transitions to a round shape.

17. A furnace, comprising:

a furnace cabinet comprising a cabinet outlet that is configured to receive a flue vent therethrough;

a burner configured to be disposed within the furnace cabinet;

an inducer blower configured to be disposed within the furnace cabinet, a flue vent adapter comprising:

an inlet configured to be coupled to the inducer blower;

an outlet configured to be coupled to the flue vent transition;

a substantially 90 degree bend disposed between the inlet and the outlet;

a plurality of transitions to provide clearance for the burner when the flue vent adapter is disposed within the furnace cabinet, wherein the plurality of transitions comprises:

a first transition disposed between the bend and the outlet; and a second transition disposed between the first transition and the outlet;

wherein, when moving from the bend toward the outlet, the first transition includes a round shape that transitions into an elliptical shape and the second transition includes an elliptical shape that transitions to a shape of the outlet, and a flue vent transition configured to be coupled between the outlet of the flue vent adapter and the flue vent, wherein the flue vent transition transitions from the shape of the outlet to a shape of the flue vent.

18. The furnace of claim 17, wherein the inlet comprises a substantially rectangular shape, and wherein the shape of the outlet comprises at least one of a substantially rectangular shape and a substantially round shape.

19. The furnace of claim 17, wherein the flue vent adapter comprises a third transition between the inlet and the bend, wherein the third transition includes a rectangular shape that transitions to a shape of the bend.

20. The furnace of claim 17, wherein the shape of the bend comprises a round shape.

21. The furnace of claim 17, wherein the flue vent adapter further comprises an elliptical portion that is between the first and second transitions.

22. The furnace of claim 17, further comprising: a rolled bead disposed adjacent the outlet, wherein the rolled bead is configured to provide a stop for the second transition.

* * * * *